US007287991B1

(12) United States Patent
Li

(10) Patent No.: US 7,287,991 B1
(45) Date of Patent: Oct. 30, 2007

(54) MULTI-SECTIONAL PLUG ROTATING AND POSITIONING STRUCTURE OF A POWER CONNECTOR

(75) Inventor: Chen-Yu Li, Taoyuan Hsien (TW)

(73) Assignee: SPI Electronics Co., Ltd., Taoyuan Hsien (TW)

( * ) Notice: Subject to any disclaimer, the term of this patent is extended or adjusted under 35 U.S.C. 154(b) by 0 days.

(21) Appl. No.: 11/585,843

(22) Filed: Oct. 25, 2006

(51) Int. Cl.
*H01R 13/44* (2006.01)

(52) U.S. Cl. ..... 439/131; 439/172

(58) Field of Classification Search ..... 439/131, 439/170, 171–174, 104
See application file for complete search history.

(56) References Cited

U.S. PATENT DOCUMENTS 6,312,271 B1 * 11/2001 Tseng ..... 439/131
6,494,727 B2 * 12/2002 Wen-Ching ..... 439/131
6,544,051 B1 * 4/2003 Su ..... 439/131
6,641,412 B2 * 11/2003 Kitagawa et al. ..... 439/131
2002/0151199 A1 * 10/2002 Yao ..... 439/131
2002/0173183 A1 * 11/2002 Segawa et al. ..... 439/131

FOREIGN PATENT DOCUMENTS

TW 568433 12/1992

* cited by examiner

*Primary Examiner*—Hien Vu
(74) *Attorney, Agent, or Firm*—Birch, Stewart, Kolasch & Birch, LLP

(57) ABSTRACT

In a multi-sectional plug rotating and positioning structure, a power connector includes a casing, a plug having a pivotal axle pivotally coupled to the casing and a rotating route, a gear disposed on the pivotal axle and driven by the pivotal axle and having a plurality of gear tooth portions, a limit plate positioned in the casing, and a latch portion extended from the limit plate and corresponding to the gear tooth portions. The latch portion of the plug is coupled to the gear tooth portion to define a limit relation in the rotating route. The plug can be rotated with respect to the casing to reduce volume and facilitate carrying the product. The gear of the pivotal axle is latched to the limit plate, so that the plug gives a multi-sectional positioning effect in the rotating route to provide hand feels for rotation and positioning.

5 Claims, 3 Drawing Sheets

MULTI-SECTIONAL PLUG ROTATING AND POSITIONING STRUCTURE OF A POWER CONNECTOR

FIELD OF THE INVENTION

The present invention relates to a plug fixing structure of a power connector, and more particularly to a design for fixing a plug with multiple sections when the plug is rotated.

BACKGROUND OF THE INVENTION

As electronic industry blooms and science and technology advances, an electronic product tends to be developed with a compact size, easy-to-carry and convenient-to-use design.

In the early stage, a traditional structural design of a power connector for electronic products such as a transformer usually comes with a plug fixed at a predetermined position of a casing and the direction of inserting the plug cannot be changed. Furthermore, the overall size of the product cannot be reduced, and users cannot carry or store the power connector easily. With the consideration of compact size and convenience of use, a power connector with a rotary plug becomes a key point for the design of power connectors.

Referring to R.O.C. Patent Publication No. 568433, a traditional power connector with a rotary plug is disclosed. The power connector includes a casing, an embedding base disposed at a closed end of the casing, a plug structure disposed in the embedding base for fixing an insert terminal into a rotary body and driving the rotary body to rotate and change the insert direction or reduce the volume for an easy storage, a conducting wire soldered at a distal end of the insert terminal in the casing, so as to provide the function of rotating the plug structure as well as electrically connecting the conducting wire with a circuit board. The patented invention also discloses another rotating structure of a plug. Similarly, an embedding base of a casing has a plug structure comprised of two insert terminals, two conducting plates, a transversal rod, a support member and a spring. The two insert terminals and the two conducting plates are riveted together and embedded on both sides of the transversal rod, and the transversal rod is positioned in the embedding base by a support member, and an end of a spring is installed into an accommodating hole of the casing, and another end of the spring is installed into a blind hole in the support member for achieving the rotation of the plug and the tightness of the rotation.

These prior arts can achieve the function of rotating the plug with respect to the power connector and the plug can rotate with respect to the casing and such arrangement has improvements over the traditional design of a fixed plug structure, these improvements include the advantages of a reduced volume of the product and an easy carry of the product. Users can use the rotating power connector to adjust the insert angle depending on different insert spaces, but the plug does come with a multi-sectional positioning effect and cannot fix the plug with the power connector at different angles. The power connector may be moved freely or even loosened, when an external force is exerted onto the plug, and thus the prior arts require further improvements.

SUMMARY OF THE INVENTION

The primary objective of the present invention is to provide a plug rotating and positioning structure of a power connector, wherein the plug can be rotated with respect to the casing to reduce the volume of the product and provide an easy way of carrying the product, and a gear of a pivotal axle of the plug can be latched with a limit plate, such that the plug can provide a multi-sectional positioning effect in the rotating route to provide hand feels for rotation and positioning.

To achieve the foregoing objective, the present invention discloses a preferred embodiment of the present invention, and a power connector of the invention includes a casing, a plug having a pivotal axle pivotally coupled to the casing and a rotating route, a gear disposed on the pivotal axle and driven by the pivotal axle and having a plurality of gear tooth portions and a limit plate positioned in the casing, and a latch portion extended from the limit plate and corresponding to the gear tooth portions. The latch portion of the plug in the rotating route is coupled to the gear tooth portion to define a limit relation.

DETAILED DESCRIPTION OF THE PREFERRED EMBODIMENTS

To make it easier for our examiner to understand the objective of the invention, its structure, innovative features, and performance, we use a preferred embodiment together with the attached drawings for the detailed description of the invention.

Figure 1:
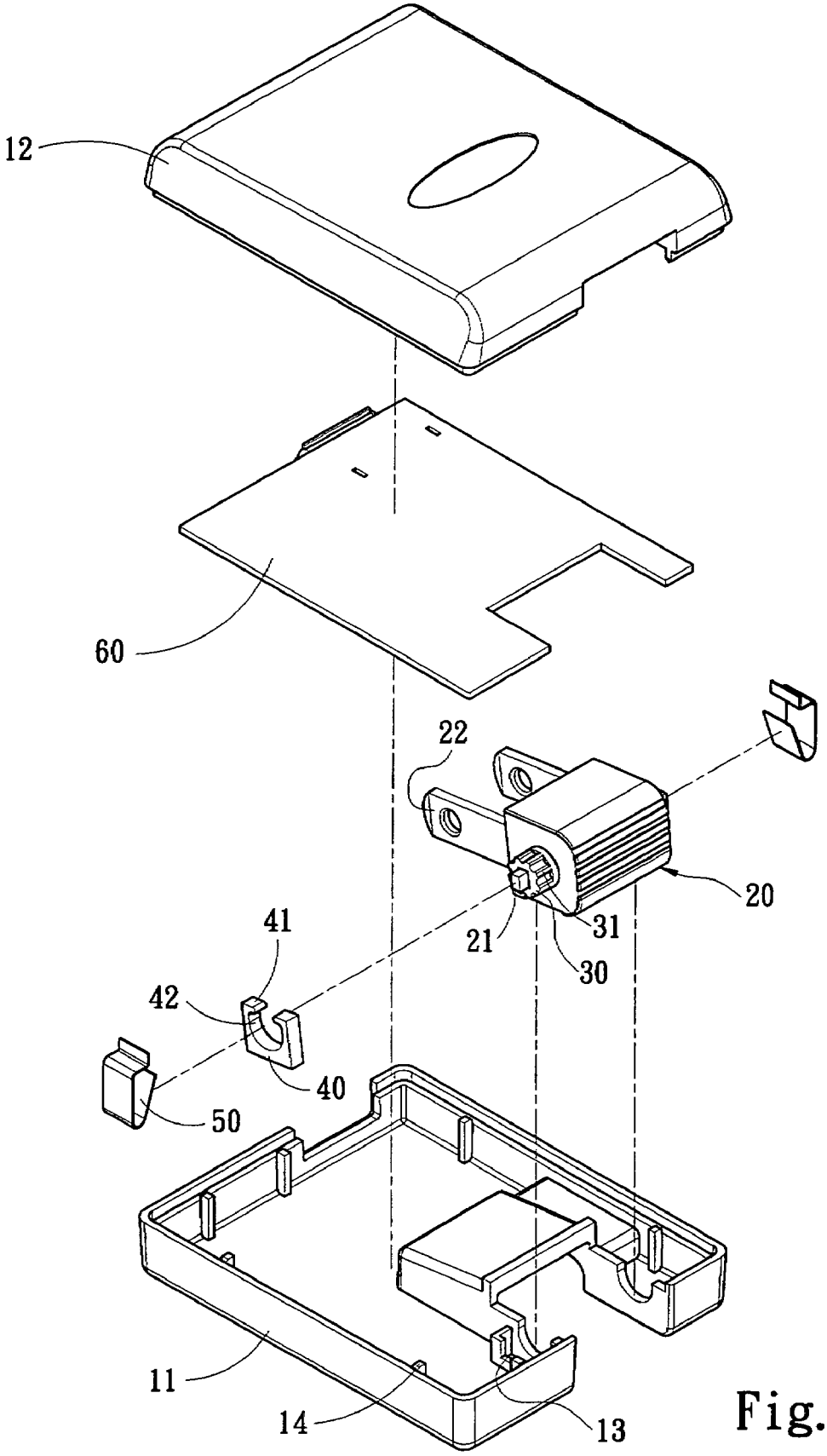
FIG. 1 is an exploded view of a structure in accordance with a preferred embodiment of the present invention.
Figure 2A:
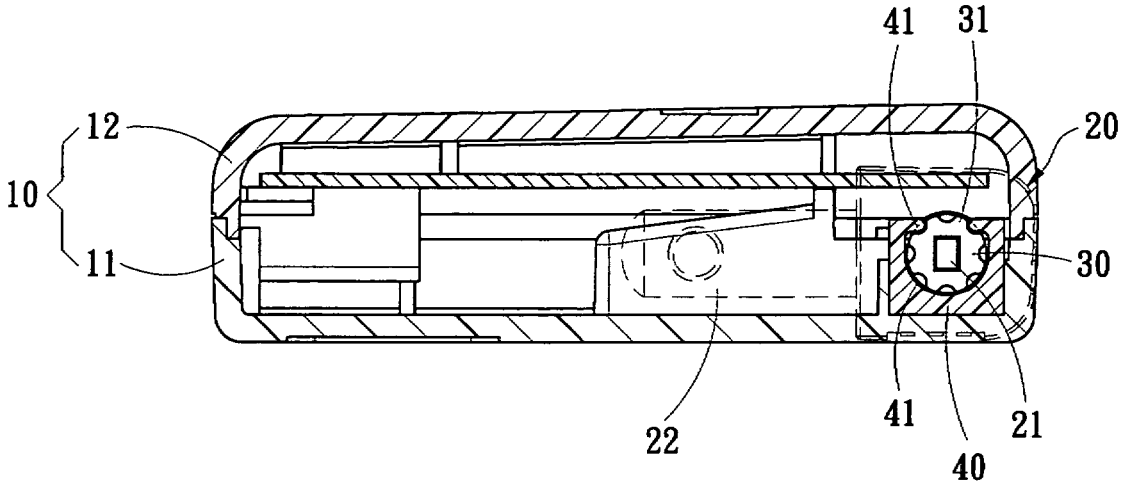
FIGS. 2A~2C are schematic views of successive movements of a structure in accordance with a preferred embodiment of the present invention.

Referring to FIG. 1 for an exploded view of a structure in accordance with a preferred embodiment of the present invention, a multi-sectional plug rotating and positioning structure of the invention includes a power connector, and the power connector comprises a casing 10, a terminal 22 and a circuit board 60. The power connector could be any type of power connectors such as a power connector of a transformer. The casing 10 is composed of a base 11 and an upper casing 12 coupled to the base 11 as shown in FIG. 2A, and the plug 20 is pivotally coupled to the casing 10. The plug 20 includes a pivotal axle 21 for pivotally coupling the casing 10 such that the plug 20 can create a rotating route with respect to the casing 10, and a gear 30 disposed on the pivotal axle 21 and driven by the pivotal axle 21 and having a plurality of gear tooth portions 31, wherein both sides of the plug 20 have a separate pivotal axle 21, and one of the pivotal axles 21 has the gear 30 (or both pivotal axles 21 have the gear 30), a limit plate 40 positioned in the casing 10 by a positioning slot 13, and a latch portion 41 extended from the limit plate 40 and corresponding to the gear tooth portion 31. The limit plate 40 has a flexible arm 42, and the latch portion 41 is disposed at a distal end of the flexible arm 42 and the latch portion 41 is flexible. Further, the casing 10 includes a flexible bracket 50, and a blocking member 14 for positioning the flexible bracket 50, and the flexible bracket 50 normally presses against a distal end of the pivotal axle 21 to provide the tightness for rotating the plug 20.

Figure 2B:
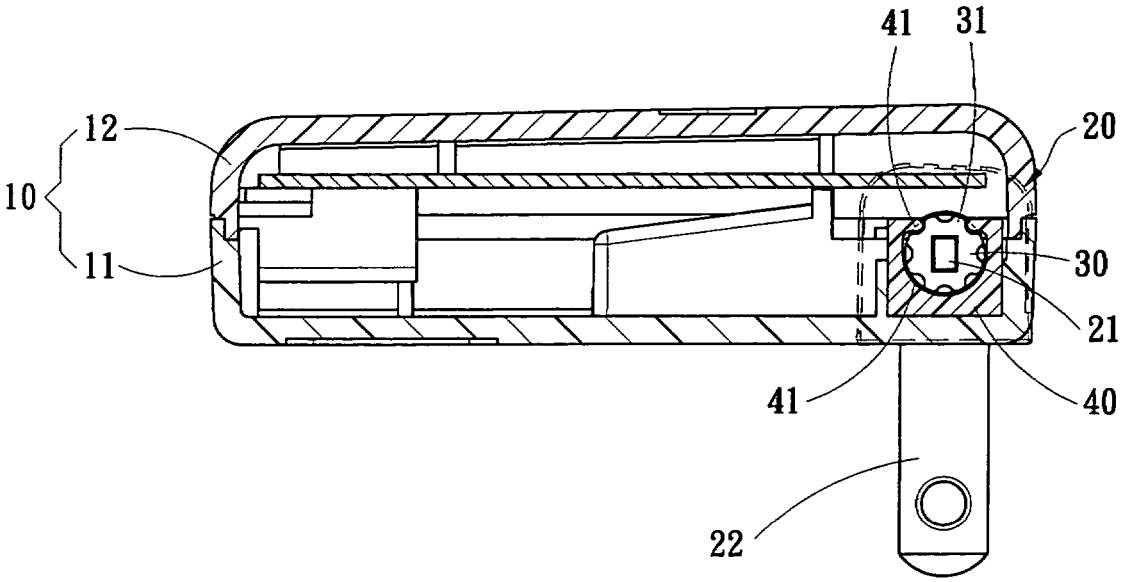
Figure 2C:
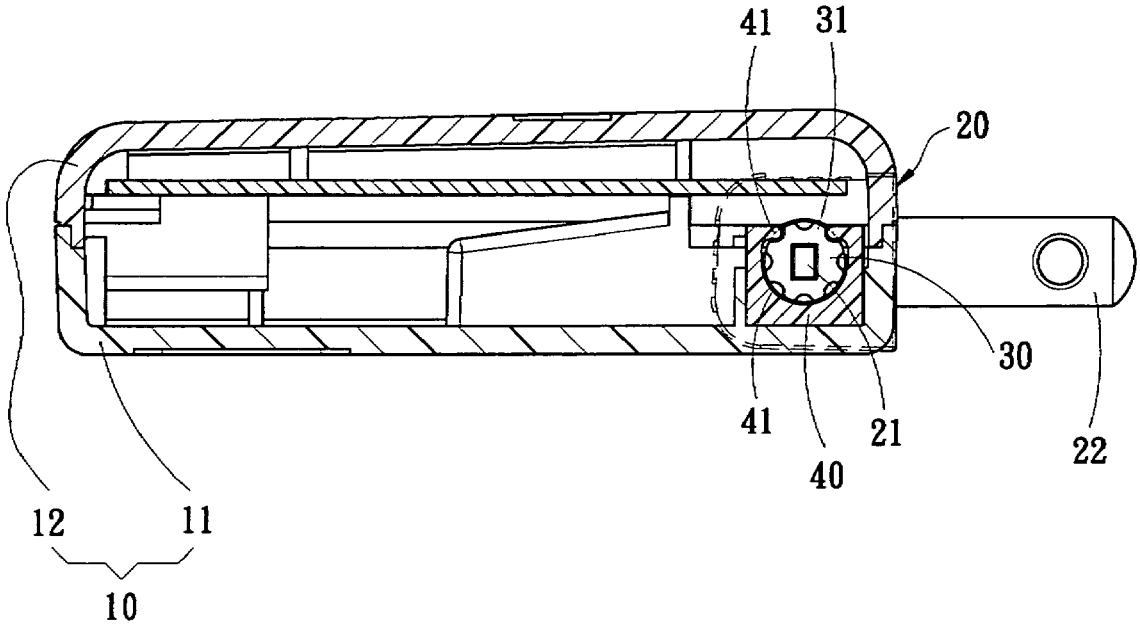

Referring to FIGS. 2A~2C for schematic views of successive movements of a structure in accordance with a preferred embodiment of the present invention, the casing 10 is pivotally coupled to the plug 20, such that the plug 20 can be rotated with respect with the casing 10. If the structure is not in use, the plug 20 can be turned under the casing 10 as shown in FIG. 2A, and thus giving the advantages of reducing volume and facilitating its storage and carrying. If a user needs to insert the structure, the user can apply a force to the plug 20 to turn it outward as shown in FIGS. 2B and 2C. Users can adjust the insert angle to fit different environments. Further, the latch portion 41 of the limit plate 40 can be coupled to the gear tooth portion 31 of the gear 30 to define a limit relation in the rotating route of the plug 20 and produce a positioning effect. If a force is applied to overcome the latching force of the latch portion 41, the gear tooth portion 31 in the rotating route will press against the latch portion 41 to release the limit relation, such that the plug 20 can provide a multi-sectional positioning effect when it is rotated, and the plug 20 can be fixed to the power connector in different insert angles. Thus, the power connector will not be moved freely or loosened by external forces easily, when the plug 20 is inserted. In summation of the description above, the plug 20 of the invention can be rotated with respect to the casing 10 to reduce volume and facilitate storage and carrying, and the gear 30 disposed on the pivotal axle 21 of the plug 20 is latched to a limit plate 40, so that the plug 20 can have a multi-sectional effect in the rotating route to give hand feels for rotation and positioning.

While the invention has been described by means of specific embodiments, numerous modifications and variations could be made thereto by those skilled in the art without departing from the scope and spirit of the invention set forth in the claims.

What is claimed is:

1. A multi-sectional plug rotating and positioning structure of a power connector, said power connector comprises a casing and a plug having a pivotal axle pivotally coupled to said casing and having a corresponding rotating route, said pivotal axle comprises:

a gear driven by said pivotal axle and at one end of said pivotal axle and having a plurality of gear tooth portions;

a limit plate positioned in said casing; and a latch portion extended from said limit plate and corresponding to one of said gear tooth portions;

said latch portion of said plug being coupled with said gear tooth portions to define a limit relation in said rotating route;

wherein said limit plate includes a flexible arm, and said latch portion is disposed at an end of said flexible arm, and said corresponding gear tooth portion is pressed against said latch portion in said rotating route to release said limit relation;

wherein said casing includes flexible brackets therein, and each of said brackets normally presses against one of side ends of said pivotal axle.

2. The multi-sectional plug rotating and positioning structure of a power connector of claim 1, wherein said casing includes a positioning slot therein for positioning said limit plate.

3. The multi-sectional plug rotating and positioning structure of a power connector of claim 1, wherein said casing includes a blocking member therein for positioning said bracket.

4. The multi-sectional plug rotating and positioning structure of a power connector of claim 1, wherein said pivotal axle is disposed separately on both sides of said plug, and one of said pivotal axles includes said gear.

5. The multi-sectional plug rotating and positioning structure of a power connector of claim 1, wherein said pivotal axle is disposed separately on both sides of said plug, and both pivotal axles have said gear.

* * * * *